United States Patent [19]

King

[11] 4,028,579

[45] June 7, 1977

[54] HIGH CURRENT DENSITY ION SOURCE

[75] Inventor: Harry J. King, Woodland Hills, Calif.

[73] Assignee: Hughes Aircraft Company, Culver City, Calif.

[22] Filed: June 29, 1976

[21] Appl. No.: 701,000

Related U.S. Application Data

[63] Continuation of Ser. No. 516,718, Oct. 21, 1974, abandoned.

[52] U.S. Cl. ..... 313/361; 60/202; 313/362

[51] Int. Cl.² ..... F03H 5/00; H05H 5/02

[58] Field of Search ..... 60/202; 313/360, 361, 313/362

[56] References Cited

UNITED STATES PATENTS

| | | | |
|---|---|---|---|
| 3,304,718 | 2/1967 | Zimmerman | 60/202 |
| 3,311,772 | 3/1967 | Speiser et al. | 60/202 X |
| 3,697,793 | 10/1972 | King | 60/202 X |

OTHER PUBLICATIONS

Article Entitled, "Neutral–Beam Research and Development at LBL Berkeley," by W. R. Baker et al, published as part of the proceedings of the 5th Symposium on Engineering Problems of Fusion Research at Princeton, N.J., Nov. 6–9, 1973, pp. 413–417.

*Primary Examiner*—Palmer C. Demeo
*Attorney, Agent, or Firm*—Allen A. Dicke, Jr.; W. H. MacAllister

[57] ABSTRACT

High current density ion source with high total current is achieved by individually directing the beamlets from an electron bombardment ion source through screen and accelerator electrodes. The openings in these screen and accelerator electrodes are oriented and positioned to direct the individual beamlets substantially toward a focus point.

8 Claims, 3 Drawing Figures

HIGH CURRENT DENSITY ION SOURCE

This is a continuation of application Ser. No. 516,718, filed Oct. 21, 1974, and now abandoned.

BACKGROUND OF THE INVENTION

This invention is directed to a high current density ion source, and particularly to an arrangement for focusing the ions extracted from the discharge in an electron bombardment ion source.

Electron bombardment ion sources are known for the production and acceleration of ion beams. Kaufman U.S. Pat. No. 3,156,090 is the original application of electron bombardment ion sources to space thrusters. Petrick U.S. Pat. No. 3,159,967 is another disclosure of that kind of source. Speiser et al. U.S. Pat. No. 3,311,772 discusses the problem of providing uniform thrust direction for an electron bombardment ion thruster in which the plasma density is nonuniform across the source. Prior effort has been directed to the problem of providing an ion beam which has a uniform thrust direction for maximum thrust efficiency.

SUMMARY OF THE INVENTION

In order to aid in the understanding of this invention it can be stated in essentially summary form that is directed to simultaneously generating a high total current and high current density ion beam of virtually any ion species. An electron bombardment ion source is provided with a screen and an accelerator electrode which have corresponding openings or perforations for the discharge of individual beamlets. The corresponding perforations are positioned with respect to each other so that the direction of individual beamlets can be controlled. They are generally directed toward a focus point to increase the current density.

It is thus an object of this invention to provide an ion source which is capable of high current density. It is a further object to provide an electron bombardment ion source in which the current density is increased by focusing the ion beam therefrom. It is another object to focus the output beam of an electron bombardment ion source to provide a higher ion current density than is available from a conventional source. It is yet another object of this invention to direct the individual beamlets from a multiple aperture electron bombardment ion source so that the beamlets are substantially directed to a focus point to provide enhanced current density. It is another object to tailor the current density in the beam to have any unique profile.

Other objects and advantages of this invention will become apparent from a study of the following portion of the specification, the claims and the attached drawings.

DESCRIPTION OF THE PREFERRED EMBODIMENT

Figure 1:
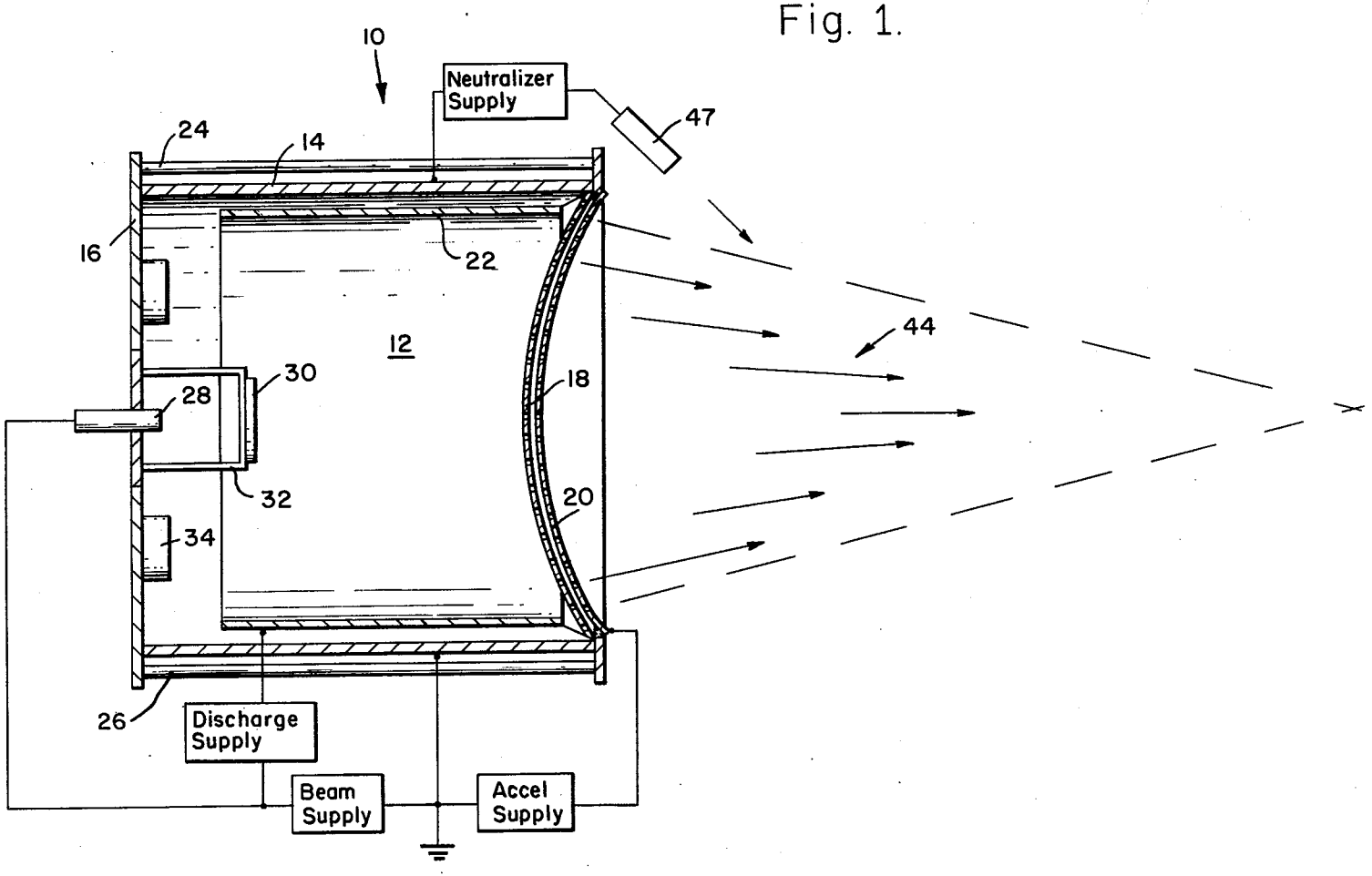
FIG. 1 is a schematic section through an electron bombardment ion source showing beam focusing therefrom.

A Kaufman type electron bombardment ion source is generally indicated at 10 in FIG. 1. It includes a chamber 12 formed by outer walls 14, front wall 16 and electrodes 18 and 20. Anode 22 is a cylindrical tube positioned just inside of outer wall 14 and defines the effective outer limit of the plasma discharge. Magnets 24 and 26 are positioned to provide a substantially axial magnetic field, in the plane of the paper of FIG. 1 and from left to right through the ion source 10. Cathode 28 extends in through front wall 16. It is a thermionic cathode which is heated and it is electrically isolated from the remainder of this structure. Other types of cathodes can also be used. Baffle 30 is mounted directly in front of the cathode on mounting legs 32. The material to be ionized is introduced into the chamber in gaseous or vapor form through gas distributer 34. A thermionic cathode could be used without the baffle.

The mechanism of the discharge as explained in detail in "Investigation of the Discharge in Electron Bombardment Thrusters" By W. Knauer, G. Hagan, H. Gallagher and E. Stack in AIAA Paper No. 66-244 presented at the American Institute of Aeronautics and Astronautics 5th Electric Propulsion Conference held at San Diego, Calif., Mar. 7–9, 1966.

In general, electrons from the thermionic cathode 28 spiral toward anode 22 under the influence of the magnetic field. In the spiral path, ionizing collisions occur with the to-be-ionized gas introduced into the discharge chamber. These collisions are cascading collisions to cause an ionized plasma present in the discharge chamber. Electrons are attracted toward the anode, while ions float throughout the chamber.

Electrons emitted from the thermionic cathode are drawn across the plasma sheath into the discharge plasma which fills the volume of the discharge chamber. The potential of the plasma is near anode potential. The injected electrons thus possess sufficient energy to ionize the gas in the chamber. The applied magnetic field confines the electrons axially, and then forces them to travel back and forth between the cathode and the screen electrode 18. After several thousand passes and as the result of collisions they are eventually collected at the anode 22. Because of the long life of the electrons the gas can be efficiently ionized even at very low pressures. Only those ions with random motion toward the screen electrode are extracted into the ion beam. In a typical electron bombardment ion source, the ratio of extracted to generated ions can be expected to be in the order of ⅓. When there are a plurality of beam opening in the electrodes, a plurality of beamlets are formed. Individual direction of these beamlets toward a focus point is accomplished by misalignment of the individual apertures. Relative misalignment of 10 percent of the aperture diameter results in a beamlet deflection of about 8°.

Screen electrode 18 is at the potential of outer wall 14, and the ions in the plasma float toward the plasma sheath adjacent to the screen. Accelerator electrode 20 is made negative to accelerate the positive ion beam. Potentials are supplied to the cathode, anode and accelerator electrode as indicated by the potential connections at the bottom of FIG. 1. The beam is formed and accelerated by the two closely spaced perforated electrodes. In order to develop the desired high ion current, a plurality of perforations are required. Beamlet openings 36 and 38, for example, are formed in screen electrode 18, while corresponding electrode openings for the formation of beamlets are indicated at 40 and 42 are formed in accelerator electrode 20.

Figure 2:
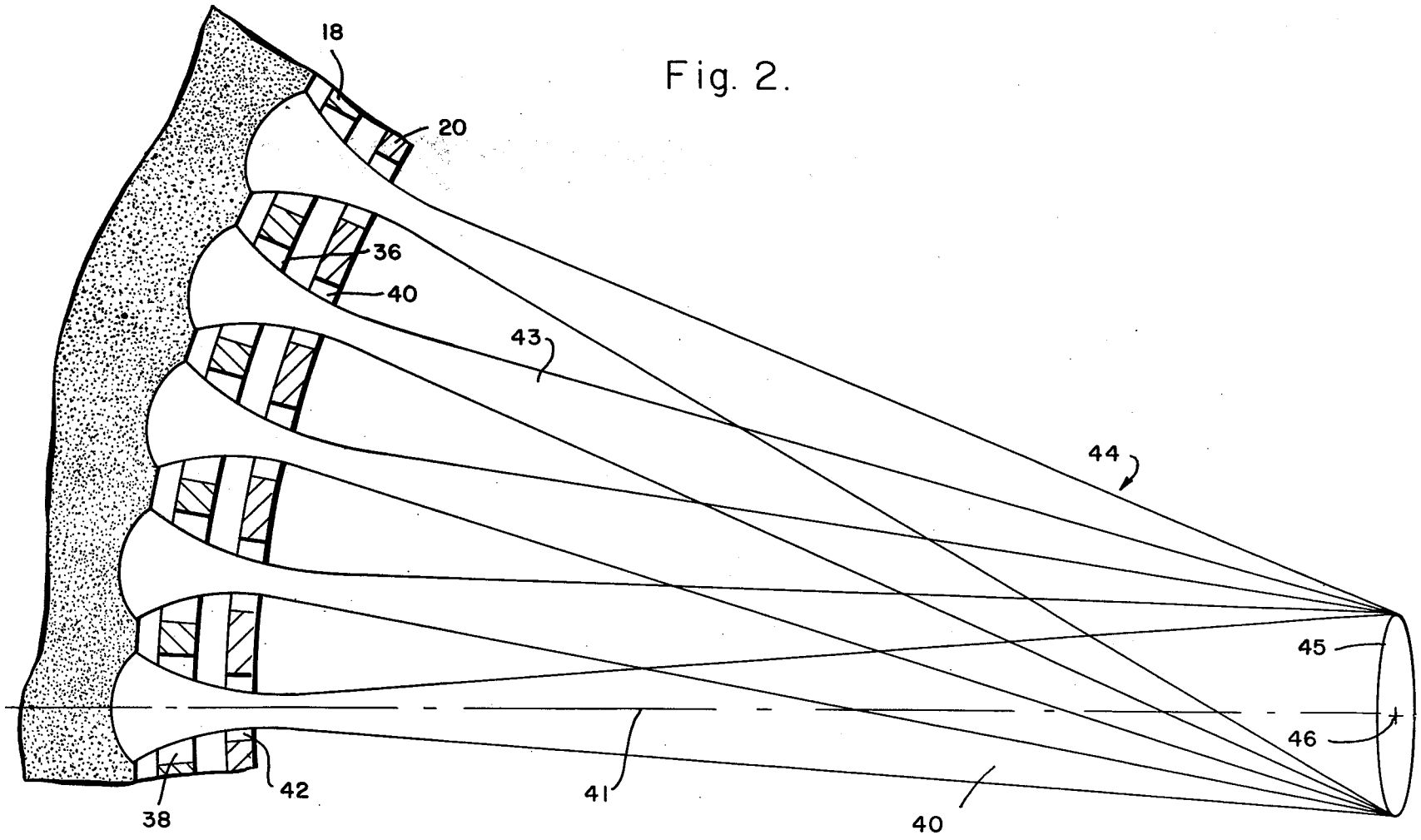
FIG. 2 is an enlarged partial section through the electrodes of the source of FIG. 1, with parts broken away.

The preferred structure of the arrangement of the screen and accelerator electrodes is shown in FIG. 2 where they are both dished to a spherical radius. The spherical radius can be the same for both electrodes to maintain constant spacing therebetween. Portions of the electrodes are shown to show examples of relative beamlet opening positioning. Furthermore, the beamlet opening arrangement of FIG. 2 is a specialized case for putting the focus point 46 on the center of the spherical radius. Ths axis of the ion source and the axis of the electrodes is indicated at 41. Electrode openings 38 and 42 are on axis 41 and form beamlet 40 on the axis. Electrode openings 36 and 40 are away from axis 40 and are on the same spherical radius directed at focus point 46 which is also the center of spherical radius. Beamlet 43 extends through those openings, and it is seen that, as the beamlet expands in its path to the focus point, it overlaps with the image of beamlet 40. All beamlet openings are on spherical radii so they direct the beamlets to the focus points. Thus the beamlets are directed at the focus point with the result that considerable enhanced current density is achieved. It is understood that each of the beamlets spreads from the accelerator electrode and, as the beamlets overlap toward the focus point, various effects prevent maintaining the beamlets as tight as they are when they pass through their opening in the accelerator electrode. Thus, the image 45 of the overlapped beams is not as small as the individual beamlets at their narrowest point.

As described above the structure of FIG. 2 illustrates the special case where the focus point is at the center of spherical radius. If it is desired that the focus point be closer to the electrodes than the center of spherical radius, then the relative positioning of the off axis electrode openings is different. For closer focusing, off axis accelerator electrode openings such as opening 40 are moved radially outward to cause beam bending toward a closer focus point. For a focus point beyond the center of spherical radius, the accelerator openings are positioned radially inward with respect to axis 41. The screen and accelerator electrodes are separately perforated, such as by photoresistant etch techniques, so that different positioning of the holes and different size holes can be conveniently achieved. The electrodes are perforated in the flat condition and, thereafter, are dished by hydroforming. The dishing of the electrodes achieves mechanical stability for the thin electrodes to maintain the separation between the electrodes and maintains the mechanical strength over the entire electrode diameter.

In another special case, the two electrodes originate as flat plates, with opening 36 lined up with its corresponding opening 40 while opening 38 is lined up with its corresponding opening 42. This permits the drilling of the two plates together, in stacked position so that there is a proper interrelationship between each of the openings. After all of the openings are produced, the two electrodes are dished to the desired spherical concave form. Each of the electrodes has the same spherical radius. This dishing rearranges the opening alignment or redirects the openings to cause convergent focusing of the beam. The convergent character of the gross beam made up of the many beamlets is generally the same as indicated in FIG. 1. In this case, focusing would be expected to be closer than the center of spherical radius.

While each of the beamlets can be directed toward focus point 46, the build up of space charge with resultant mutual repulsion of the ions prevents sharp focusing. Electron emitter 47 directs an electron beam into the positive ion beam to neutralize the space charge. At the focus point there is a maximimized current density, permitted by neutralization and focus. In the structure shown in FIGS. 1 and 2 beam convergence is obtained by electrode curvature and aperture positioning. With such focusing, up to 10 times increase in current density as compared to the current density at the accelerator electrode is achieved.

TABLE I

Operating Parameters For 15 cm Diameter Focused Beam Multiaperture Ion Source

| | |
|---|---|
| Beam Current, A | 0.65 |
| Accelerator Voltage | 1000V |
| Beam Energy $V_B$ | 1.0 – 10.0kV |
| Accelerator Current, mA | 30 |
| Discharge Voltage, $V_D$ | 50 – 100V |
| Discharge Current, A | 2.4 |
| Ambient Pressure, Torr × $10^5$ | 7 |
| Current Density At Accelerator, mA/cm² Electrode 18 | 2 to 5 |
| Current Density at Plane Through, Focal Point 46 | ≈ 20 |

Figure 3:
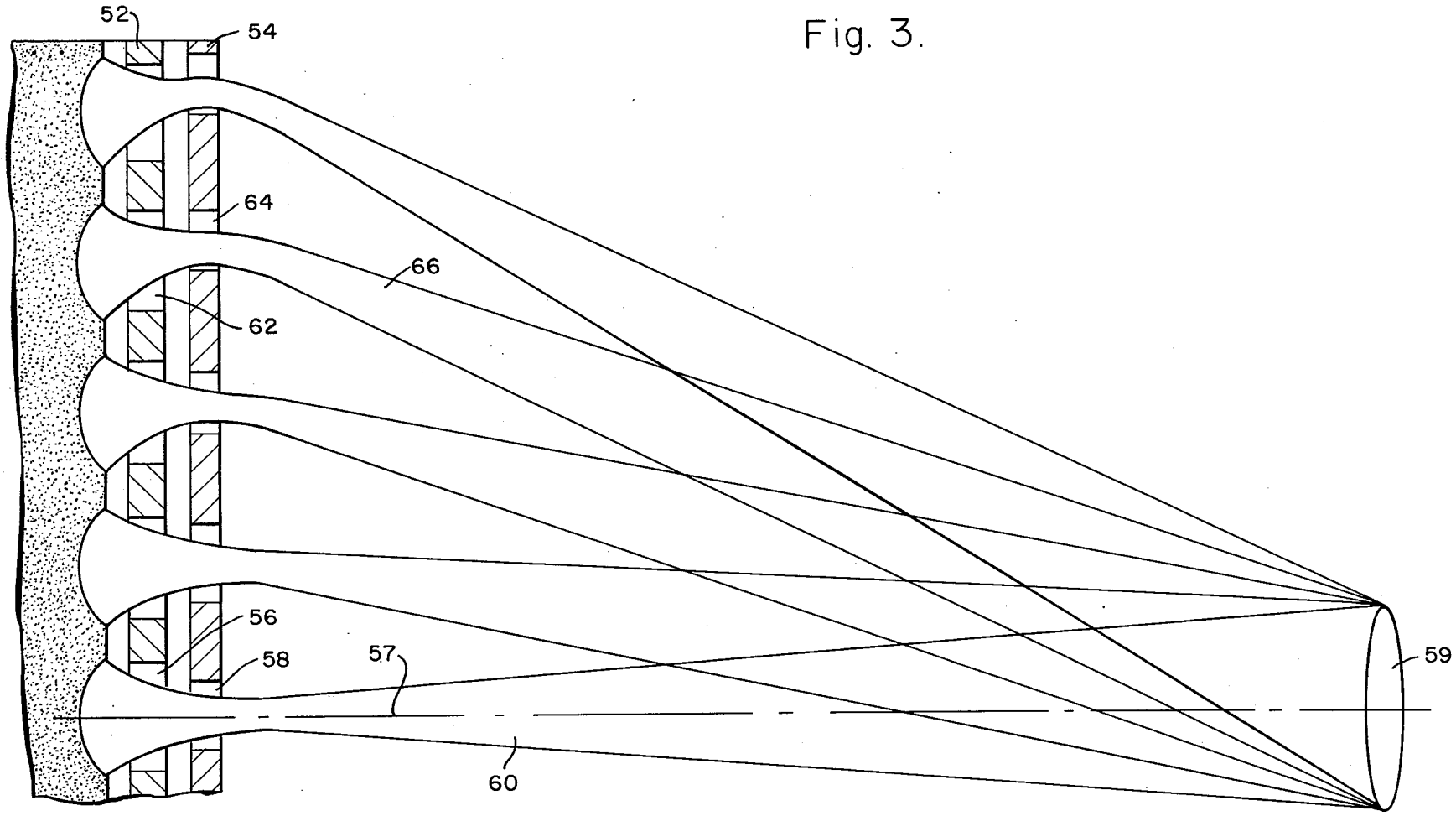
FIG. 3 is similar to FIG. 2, showing another electrode arrangement for beam focusing.

If preferred to dished electrodes, flat screen and accelerator electrodes 52 and 54 are feasible. FIG. 3 shows a structure wherein the off beamlet axis openings in flat screen electrode 52 are slightly misaligned from the beamlet openings in flat accelerator electrode 54. The on axis beamlet 60 which extends through opening 56 also extends through accelerator opening 58, with everything on axis 57 so beamlet 60 is directed toward the focus point 59. Beamlet 66 which is extracted through screen opening 62 is accelerated through accelerator electrode opening 64 so that the beamlet 66 is also directed generally toward the focus point. Since opening 64, the beamlet 66 is turned inward toward the focus point 59. By appropriate relative positioning of the openings the individual beamlets extending therethrough are properly deflected to be directed toward the focus point 59. When the electrodes 52 and 54 are employed in electron bombardment ion source 10, in place of electrodes 18 and 20, convergence toward the focus point 59 also takes place. However, the dished electrodes to FIGS. 1 and 2 are preferred, because of greater strength in the assembled condition. However, the flat plate electrodes of FIG. 3 can be employed to obtain particular beam shapes by proper interrelationship of opening alignment in the two electrodes. For example, when a substantially square beam shape is desired at a particular downstream plane through the ion beam path, such could accomplished by directing the beamlets by properly configured electrodes. Other beam shapes or even two beams can be formed by appropriate electrode hole arrangement.

This invention having been described in its preferred embodiment, and an additional embodiment disclosed, it is clear that this invention is susceptible to numerous modifications and embodiments within the ability of those skilled in the art and without the exercise of the inventive faculty. Accordingly, the scope of this invention is defined by the scope of the following claims.

What is claimed is:

1. A high current density ion source comprising:

an electron bombardment ion source having walls and a screen electrode for defining a discharge chamber, a cathode in said discharge chamber for producing electrons, said ion source having an axis passing substantially through the center of said cathode and the center of said screen electrode, an anode in said discharge chamber for collecting electrons, a magnet associated with said discharge chamber for producing a magnetic field within said discharge chamber for influencing the paths of the electrons to lengthen the paths of the electrons as they move from said cathode to said anode, gas supply means for introducing a gas to be ionized into said discharge chamber, said screen electrode having a plurality of openings therein so that a broad beam of ions is produced;

an accelerator electrode positioned adjacent said screen electrode on the opposite side thereof from said discharge chamber, a plurality of openings in said accelerator electrode each corresponding to said plurality of openings in said screen electrode;

means for connecting an electric potential to said discharge chamber, said cathode, said anode, said screen electrode and said accelerator electrode for producing ions through said corresponding openings in said screen and accelerator electrodes;

means for positioning said openings in said accelerator electrode with respect to corresponding openings in said screen electrode so that individual ion beamlets are formed with each beamlet passing through one of said openings in said screen electrode and a corresponding one of said openings in said accelerator electrode to form pairs of corresponding openings, said means for positioning said corresponding openings in said screen electrode and said accelerator electrode being for directing each individual beamlet passing through each pair of corresponding screen electrode openings and accelerator electrode openings substantially toward the same selected focus point.

2. The high current density ion source of claim 1 wherein said screen electrode and said accelerator electrode are flat electrodes and the pairs of corresponding beamlet openings therethrough are arranged with the hole pattern of openings through said accelerator electrode being at a greater radius than the corresponding beamlet openings in said screen electrode.

3. The high current density ion source of claim 1 wherein said screen electrode and said accelerator electrode are dished and are positioned in said ion source with the convex side of dished electrodes being directed towards said discharge chamber.

4. The high current density ion source of claim 3 wherein said dished electrodes are substantially partially spherical surfaces with the center of spherical radius lying substantially on said axis.

5. The high current density ion source of claim 4 wherein said dished electrodes are substantially part spherical surfaces and said beamlet openings in said accelerator electrode are each substantially on the same radius from said axis with respect to corresponding beamlet openings in said screen electrode.

6. The high current density ion source of claim 1 wherein electrons are injected into the ion stream downstream from said accelerator electrode to neutralize space charge to permit closer focusing of the ion beam.

7. An ion source comprising:

an electron bombardment discharge chamber for producing ions of a selected species, said chamber being defined at its outlet by a screen electrode having a plurality of openings therein;

an accelerator electrode positioned adjacent said screen electrode on the opposite side thereof from said discharge chamber, said accelerator electrode having openings therein, said accelerator electrode being connectable to a source of accelerating electric potential so that ions passing through openings in said screen electrode form individual ion beamlets which pass through corresponding openings in said accelerator electrode; and wherein the improvement comprises:

means for positioning said openings in said screen and accelerator electrodes with respect to each other so that said beamlets are each individually directed toward a downstream location to form a selected shaped beam cross section of smaller cross-sectional area at a location downstream from said accelerator electrode than the area at said accelerator electrode to produce a beam at the downstream location having higher current density than at said accelerator electrode.

8. The high current density ion source of claim 7 wherein electrons are injected into the ion stream downstream from said accelerator electrode to neutralize space charge to permit closer focusing of the ion beam.

* * * * *